US011982287B2

(12) United States Patent
Park et al.

(10) Patent No.: US 11,982,287 B2
(45) Date of Patent: May 14, 2024

(54) FAN SHROUD ASSEMBLY

(71) Applicant: Hanon Systems, Daejeon (KR)

(72) Inventors: Cheolun Park, Daejeon (KR); Jun Ho Kim, Daejeon (KR); Ok Ryul Min, Daejeon (KR); Sang Hyun Lee, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 18/273,051

(22) PCT Filed: Jan. 27, 2022

(86) PCT No.: PCT/KR2022/001516
§ 371 (c)(1),
(2) Date: Jul. 19, 2023

(87) PCT Pub. No.: WO2022/169204
PCT Pub. Date: Aug. 11, 2022

(65) Prior Publication Data

US 2024/0084816 A1 Mar. 14, 2024

(30) Foreign Application Priority Data

Feb. 4, 2021 (KR) ..... 10-2021-0016309

(51) Int. Cl.
*F04D 29/38* (2006.01)
*F04D 29/32* (2006.01)
*F04D 29/66* (2006.01)

(52) U.S. Cl.
CPC ..... *F04D 29/384* (2013.01); *F04D 29/329* (2013.01); *F04D 29/66* (2013.01)

(58) Field of Classification Search
CPC .... F04D 19/002; F04D 29/541; F04D 29/545; F04D 29/526; F04D 29/582;
(Continued)

(56) References Cited

U.S. PATENT DOCUMENTS

2013/0315722 A1* 11/2013 Park ..... F01P 11/12 415/182.1
2020/0291960 A1 9/2020 Faruquee et al.

FOREIGN PATENT DOCUMENTS

KR 20030070945 A 9/2003
KR 20130026100 A 3/2013
(Continued)

OTHER PUBLICATIONS

International Search Report issued in PCT/KR2022/001516 on May 9, 2022.
(Continued)

*Primary Examiner* — Brian O Peters
(74) *Attorney, Agent, or Firm* — Norton Rose Fulbright US LLP; James R. Crawford

(57) ABSTRACT

The present invention relates to a fan shroud provided in a cooling module, and an object of the present invention is to provide a fan shroud having a peripheral part configured to surround an outer periphery of a fan, and a planar part coupled to face a heat exchanger, in which a noise-reducing hole is formed at an appropriate position and defined by connecting a first hole, which extends in a circumferential direction of the peripheral part, and a second hole, which extends toward the planar part and is formed through the planar part, thereby effectively reducing BPF noise while minimizing deterioration in rigidity and durability of the fan shroud.

12 Claims, 9 Drawing Sheets

(58) Field of Classification Search
CPC .. F04D 29/547; F04D 29/663; F05D 2260/96; F01P 11/10; F01P 11/12; F01P 5/02; F01P 2005/046
See application file for complete search history.

(56) References Cited

FOREIGN PATENT DOCUMENTS

| | | | |
|---|---|---|---|
| KR | 20130111744 | A | 10/2013 |
| KR | 20150071882 | A | 6/2015 |
| KR | 20180070124 | A | 6/2018 |

OTHER PUBLICATIONS

Yoshida, et al.: "Reduction of the BPF Noise Radiated from an Engine Cooling Fan," SAE International, Technical Paper 2014-01-0631, (2014), pp. 1-7, doi: 10.4271/2014-01-0631.

* cited by examiner

FAN SHROUD ASSEMBLY

CROSS REFERENCE TO RELATED APPLICATIONS

This patent application is a national phase under 35 U.S.C. § 371 of International Patent Application No. PCT/KR2022/001516 filed Jan. 27, 2022, which claims the benefit of priority from Korean Patent Application No. 10-2021-0016309 filed Feb. 4, 2021, each of which is hereby incorporated herein by reference in its entirety for all purposes.

The present invention relates to a fan shroud assembly, and more particularly, to a fan shroud assembly in which a fan, which forcibly blows air, is supported on an air-cooled heat exchanger and coupled to the heat exchanger, and a structure capable of reducing noise during a process of blowing air is provided.

BACKGROUND ART

In general, various air conditioning systems, cooling systems, and the like are installed in vehicles. The air conditioning system approximately includes cooling and heating modules for adjusting air a temperature, a humidity, and the like in an interior space in which a vehicle occupant is present. The cooling system includes modules for cooling an engine, a motor, and the like to prevent the engine, the motor, and the like from being overheated. These various modules are configured to implement desired cooling, heating, and refrigerating operations by transferring heat while circulating heat exchange media such as a refrigerant and a coolant.

The air conditioning system or the cooling system includes various heat exchangers. Among the heat exchangers, there is an air-cooled heat exchanger that cools a heat exchange medium therein by using outside air. As well known, heat exchange efficiency is improved as a velocity of air flowing to a core of the air-cooled heat exchanger. Therefore, generally, a fan shroud is coupled to a front surface of the air-cooled heat exchanger to forcibly blow air toward the core of the heat exchanger without allowing the heat exchange to be performed only by vehicle-induced wind. The fan shroud refers to a kind of device assembling component that stably supports a fan, which includes a hub and a plurality of blades, and a motor, which is configured to rotate the fan, and enables the fan and the motor to be coupled to another device.

FIG. 1 is a perspective view of a general fan shroud assembly. As illustrated, a fan shroud 100 includes a peripheral part 110 configured to surround an outer periphery of a fan 200, and a planar part 120 coupled to face a heat exchanger. A ventilation port 150 is formed in a central portion of the peripheral part 110 and provides an empty space through which an airflow generated by the fan 200 passes to blow air. A motor provided on a shaft of the fan 200 is accommodated and supported in a hub part 151 provided at a center of the ventilation port 150. As illustrated, a plurality of fixing members 152 is disposed radially around the hub part 151 to stably fix and support a position of the hub part 151, and two opposite ends of the fixing member 152 are respectively connected to an inner peripheral edge of the peripheral part 110 and an outer peripheral edge of the hub part 151. In this case, a thickness of the peripheral part 110 may be generally larger than a thickness of the planar part 120 to increase a width of an inner peripheral edge of the peripheral part 110 connected to the fixing member 152, thereby ensuring appropriate rigidity by increasing a width of the fixing member 152. That is, as clearly illustrated in an enlarged view shown at a lower side of FIG. 1, the peripheral part 110 protrudes, and a lateral surface of the peripheral part 110 is visible, when viewed from a surface of the planar part 120. In the enlarged view in FIG. 1, a boundary between the peripheral part 110 and the planar part 120 is not clearly visible. Therefore, the peripheral part is shown in a light color, and the planar part 120 is shown in a dark color.

Meanwhile, significant noise inevitably occurs during a process in which the fan forcibly blows air. More specifically, generally, noise with a pulsation waveform having a frequency, which is the product of the number of blades and the rotational speed, occurs when a fluid, which is transported by fluid transport blades in a fluid machine, passes through a cut-off portion of the fluid machine. The noise is referred to as a blade pass frequency (BPF) noise. The blades of the fan 200 correspond to the fluid transport blades, and the ventilation port 150 corresponds to a cut-off portion. The BPF noise significantly occurs even in the fan shroud assembly when the fan 200 operates.

Various studies have been conducted to improve a shape or structure of the fan shroud to reduce the BPF noise. As an example, Korean Patent Laid-Open No. 2013-0111744 ("Fan Shroud for Reducing Noise", Oct. 11, 2013) discloses a fan shroud which is illustrated in FIG. 1 and has a plurality of long holes and a plurality of short holes disposed to be closer to an outer peripheral edge of the peripheral part 110 and formed through the planar part 120. As described above, various technologies have been conducted to reduce the BPF noise by forming the holes at appropriate positions on the fan shroud and controlling a part of the airflow passing through the ventilation port 150.

In another example disclosed in "Reduction of the BPF Noise Radiated from an Engine Cooling Fan" (Yoshida K. et al., SAE 2014 World Congress & Exhibition, Apr. 1, 2014), an attempt has been made to reduce the BPF noise by changing a shape of the fan shroud. FIG. 2 is an embodiment in which the shape of the fan shroud is changed to reduce the BPF noise according to the studies in the related art. As illustrated in the upper views in FIGS. 1 and 2, the general fan shroud is shaped such that the planar part 120 is formed in an approximately rectangular shape corresponding to a shape of the core of the heat exchanger, and the peripheral part 110 is formed on a central portion of the planar part 120. It has been known that when a portion where a gap between the blade of the fan 200 and the fan shroud is small is referred to as a narrow portion, a significant large amount of BPF noise occurs in the narrow portion. As illustrated in the lower view in FIG. 2, the study illustrated in FIG. 2 forms an additional airflow space in the narrow portion in the direction in which the fan 200 rotates, thereby consequently providing a shape change for reducing the BPF noise by expanding the narrow portion. However, there is concern that the shape change forms an asymmetric shape of the fan shroud and causes undesired vibration, which degrades the rigidity and durability of the fan shroud and the assembly of the fan shroud. Further, there is also concern that the unnecessary vibration causes new vibration noise. Furthermore, because the additional airflow space protrudes from a shape of the existing fan shroud, the additional airflow space inevitably interferes with peripheral components at the time of assembling a cooling module and applying a vehicle package.

DOCUMENT OF RELATED ART

Patent Document

1. Korean Patent Laid-Open No. 2013-0111744 ("Fan Shroud for Reducing Noise", Oct. 11, 2013)

Non-Patent Document

1. "Reduction of the BPF Noise Radiated from an Engine Cooling Fan" (Yoshida K. et al., SAE 2014 World Congress & Exhibition, Apr. 1, 2014)

DISCLOSURE

Technical Problem

Therefore, the present invention has been made in an effort to solve the above-mentioned problem in the related art, and an object of the present invention is to provide a fan shroud assembly including a fan shroud having a peripheral part configured to surround an outer periphery of a fan, and a planar part coupled to face a heat exchanger, in which a noise-reducing hole is formed at an appropriate position and defined by connecting a first hole, which extends in a circumferential direction of the peripheral part, and a second hole, which extends toward the planar part and is formed through the planar part, thereby effectively reducing BPF noise while minimizing deterioration in rigidity and durability of the fan shroud.

Technical Solution

To achieve the object, the present invention provides a fan shroud assembly including: a fan 200 including a hub coupled to a rotary shaft of a motor, and a plurality of blades provided on an outer peripheral surface of the hub; and a fan shroud 100 including a peripheral part 110 configured to surround an outer periphery of the fan 200, a planar part 120 coupled to face a heat exchanger, a ventilation port 150 provided in the form of an empty space formed in a central portion of the peripheral part 110 and configured to allow an airflow, which is generated by the fan 200, to pass through the ventilation port 150 to blow air, a hub part 151 formed at a center of the ventilation port 150 and configured to accommodate and support the motor provided on a shaft of the fan 200, and a plurality of fixing members 152 connected to an inner peripheral edge of the peripheral part 110 and an outer peripheral edge of the hub part 151 and disposed radially around the hub part 151, in which a lateral surface is formed as the peripheral part 110 protrudes from a surface of the planar part 120, and in which at least one noise-reducing hole 10 is formed through the lateral surface of the peripheral part 110 and communicates with the ventilation port 150 to control a part of the airflow passing through the ventilation port 150.

In this case, the noise-reducing hole 10 may be formed by a first hole 11 formed in the lateral surface of the peripheral part 110 and extending in a circumferential direction of the peripheral part 110.

In addition, the noise-reducing hole 10 may be formed by connecting a second hole 12 formed in the lateral surface of the peripheral part 110, extending toward the planar part 120 so as to be inclined with respect to the first hole 11, and formed through the planar part 120.

In addition, the first hole 11 and the second hole 12 may be perpendicularly connected in the noise-reducing hole 10.

When a portion where a circular shape defined by the peripheral part 110 and a rectangular shape defined by the planar part 120 overlap each other or are disposed adjacent to each other is referred to as a narrow portion, the fan shroud 100 may have upper and lower narrow portions where the circular shape of the peripheral part 110 and the rectangular shape of the planar part 120 overlap each other, and first and second intermediate narrow portions that are positions at which the peripheral part 110 has a maximum horizontal length, i.e., vertical centerline positions of the peripheral part 110, and the noise-reducing hole 10 may be formed on at least one position selected from the upper narrow portion, the lower narrow portion, and the first and second intermediate narrow portions.

In addition, the noise-reducing hole 10 may be formed only in any one selected from the first and second intermediate narrow portions.

When widths of the first and second intermediate narrow portions are widths between the circular shape of the peripheral part 110 and the rectangular shape of the planar part 120 at the positions of the first and second intermediate narrow portions, the noise-reducing hole 10 may be formed only at a side at which the width is small when the widths of the first and second intermediate narrow portions are different from each other.

In addition, the noise-reducing hole 10 may be formed such that the length of the first hole 11 is longer than the length of the second hole 12 and shorter than 5% of a circumference length of the peripheral part 110.

More specifically, the noise-reducing hole 10 may be formed such that the length of the first hole 11 is within a range of 30 to 50 mm.

In addition, the noise-reducing hole 10 may be formed such that at least one second hole 12 is formed for the single first hole 11.

In addition, the noise-reducing hole 10 may be formed such that the single second hole 12 is formed for the single first hole 11, and the second hole 12 is formed at a center position based on an extension direction of the first hole 11.

In addition, the noise-reducing hole 10 may be formed such that widths of the first and second holes 11 and 12 are within a range of 10 to 30 mm.

In addition, the peripheral part 110 may include anti-vortex serrated portions 115 formed in a serrated shape and arranged along a predetermined region of an outer peripheral surface of the peripheral part 110, and the noise-reducing hole 10 may be formed in a region excluding a region in which the anti-vortex serrated portion 115 is formed.

Advantageous Effects

According to the present invention, the hole having the optimized shape is formed at the appropriate position on the fan shroud, such that a great effect of effectively reducing the BPF noise may be obtained. More specifically, in the present invention, the noise-reducing hole is formed by connecting the first hole, which extends in the circumferential direction of the peripheral part configured to surround the fan of the fan shroud, and the second hole, which is formed through the planar part and extends toward the planar part facing the heat exchanger, and the noise-reducing hole is formed at the centerline position of the fan shroud at which the flows of air are collected, thereby effectively reducing the BPF noise by reducing interference between the peripheral part and the air.

In addition, according to the present invention, it is not necessary to form an unnecessarily large number of noise-reducing holes. In general, the rigidity and durability inevitably deteriorate when the hole is formed in any structure. Therefore, it is possible to minimize the deterioration in rigidity and durability by minimizing the number of holes.

Furthermore, in the related art, in case that the additional airflow space is formed in the narrow portion to reduce the BPF noise, the asymmetric shape of the fan shroud causes problems in which additional vibration occurs, the deterioration in rigidity and durability is caused by the vibration, and new vibration and noise occur. In contrast, the shape of the fan shroud according to the present invention does not have asymmetry, thereby basically eliminating the above-mentioned problems. Further, in the related art, the additional airflow space protrudes, which causes a problem of unnecessary interference with the peripheral object at the time of packaging the cooling module. In contrast, the present invention does not cause the problem.

DESCRIPTION OF REFERENCE NUMERALS

Figure 1:
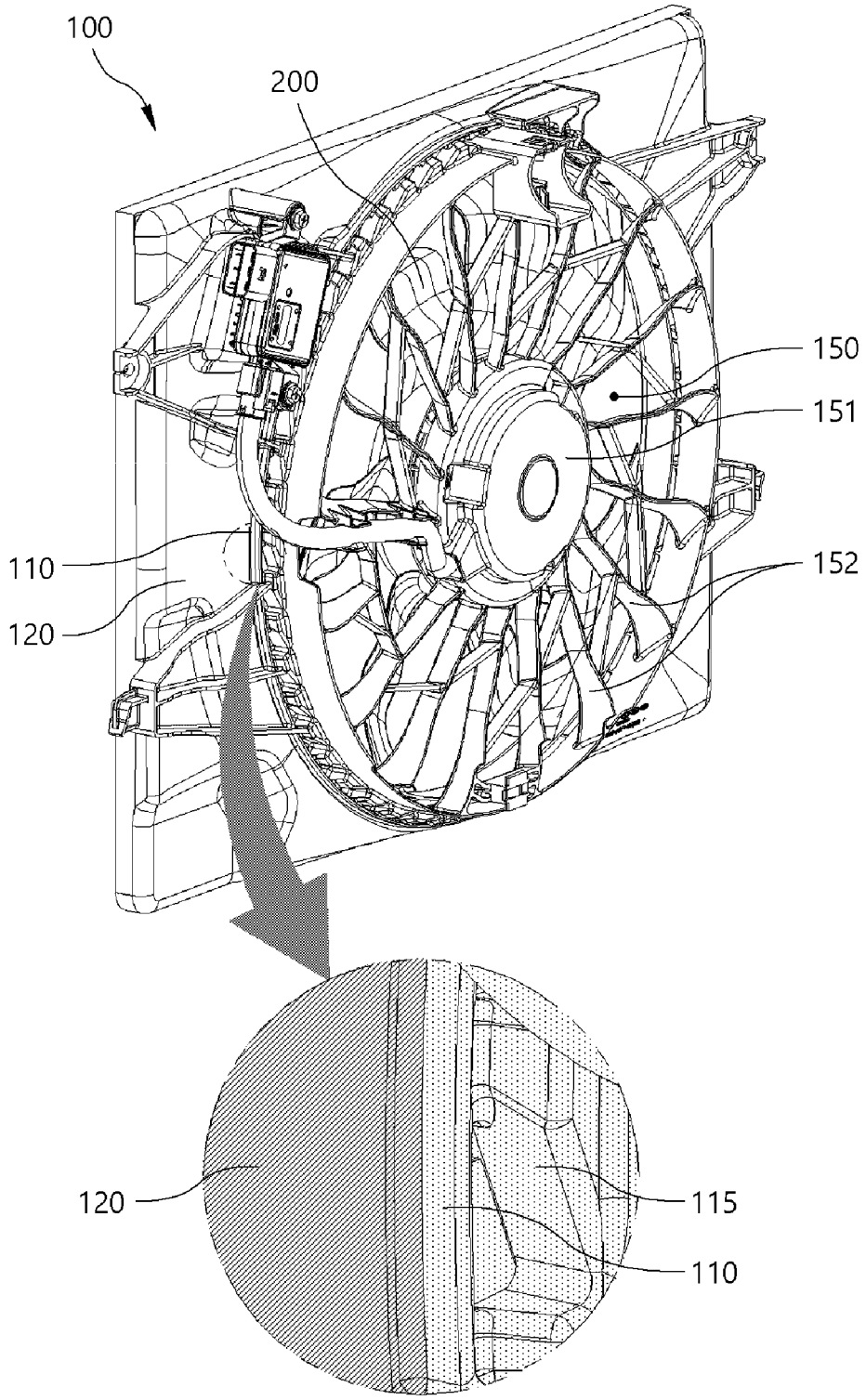
FIG. 1 is a perspective view of a fan shroud assembly in the related art.
Figure 2:
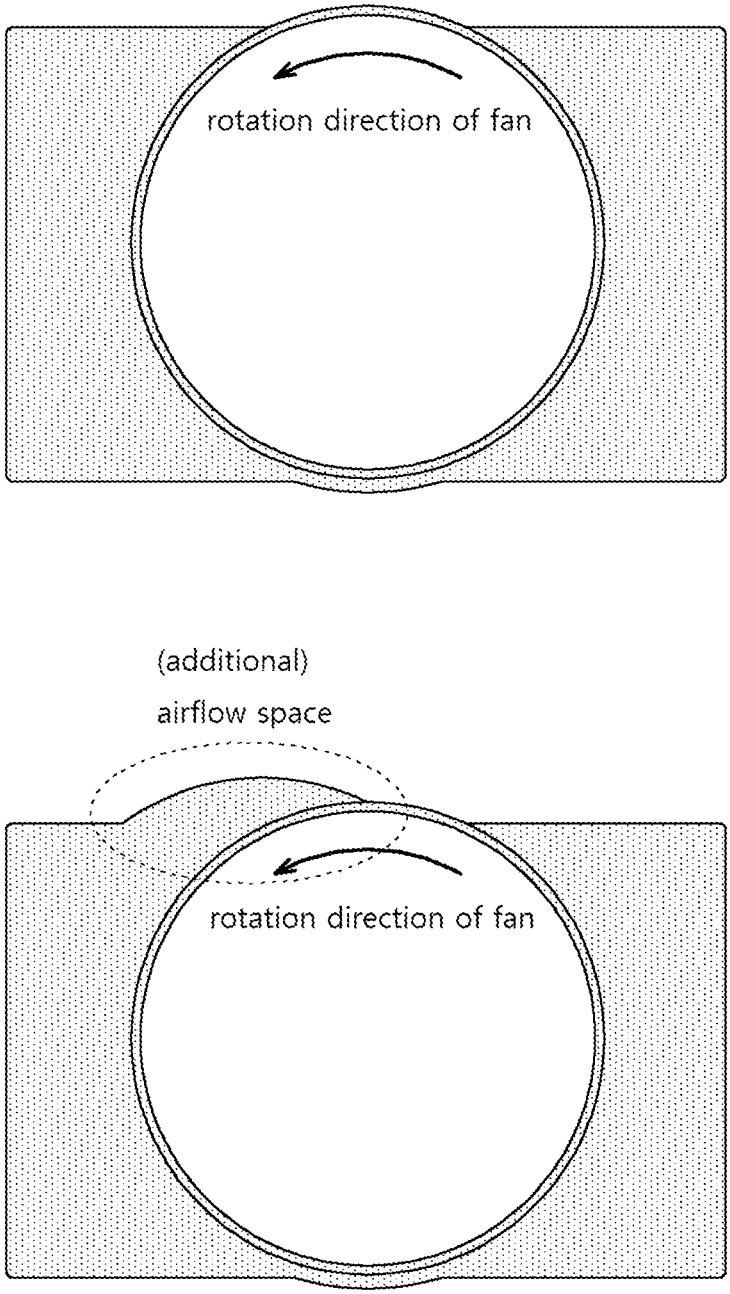
FIG. 2 is a view illustrating an embodiment in which a shape of a fan shroud is changed to reduce BPF noise in the related art.

100: Fan shroud
110: Peripheral part
120: Planar part
150: Ventilation port
151: Hub part
152: Fixing member
10: Noise-reducing hole
11: First hole
12: Second hole

MODE FOR INVENTION

Hereinafter, a fan shroud assembly according to the present invention configured as described above will be described in detail with reference to the accompanying drawings.

Figure 3:
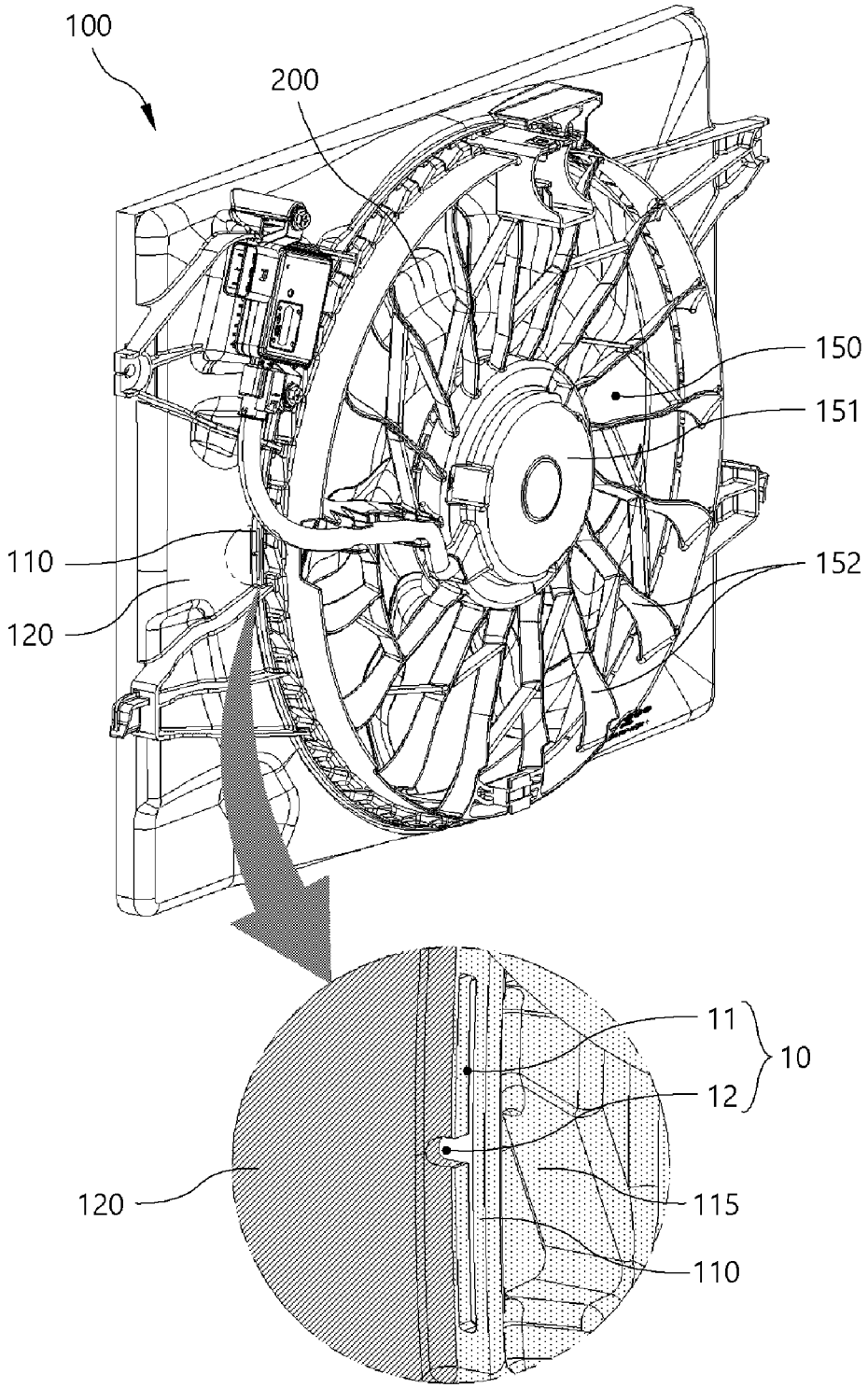
FIG. 3 is a perspective view of a fan shroud assembly of the present invention.
Figure 4:
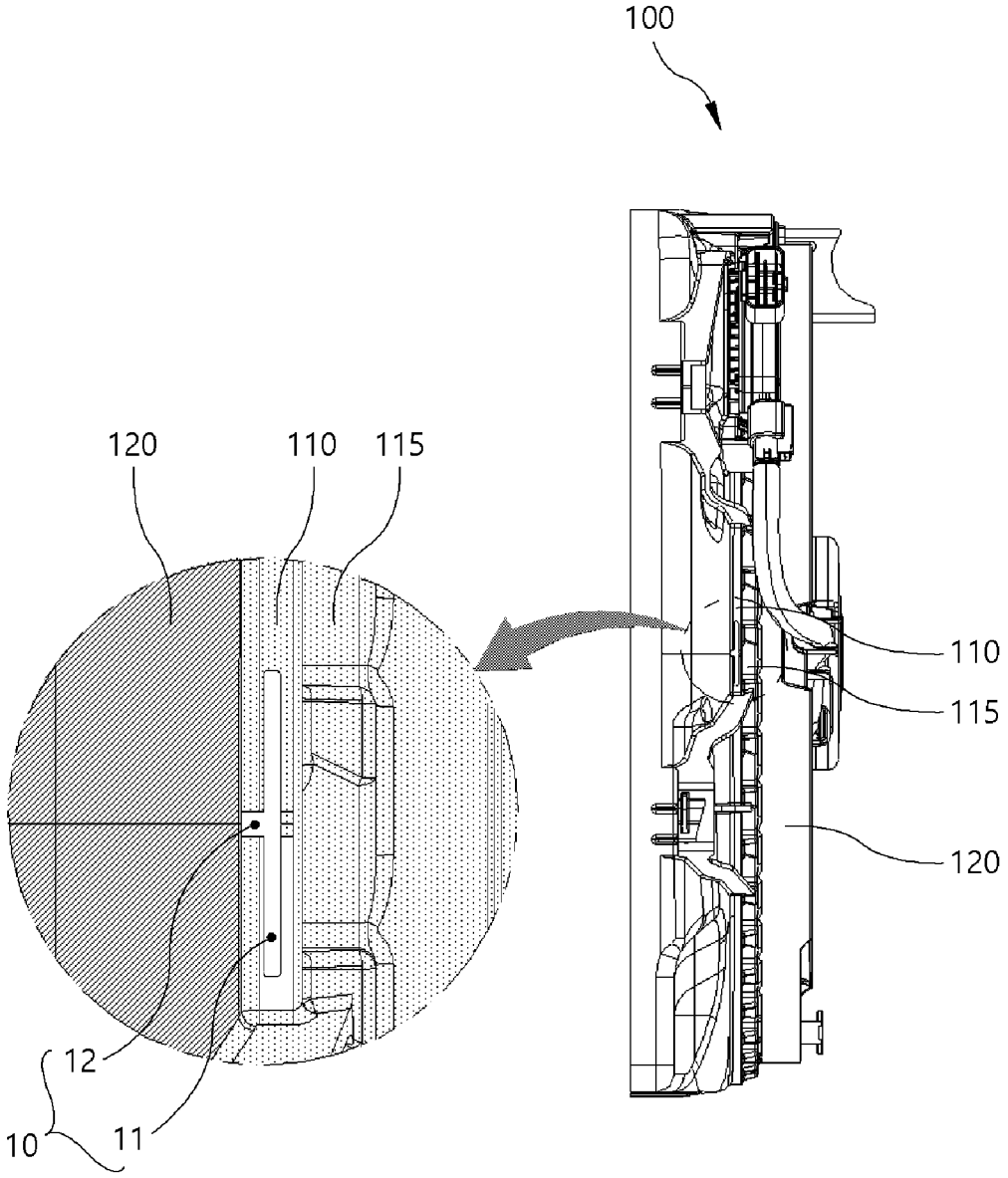
FIG. 4 is a side view of the fan shroud assembly of the present invention.
Figure 5:
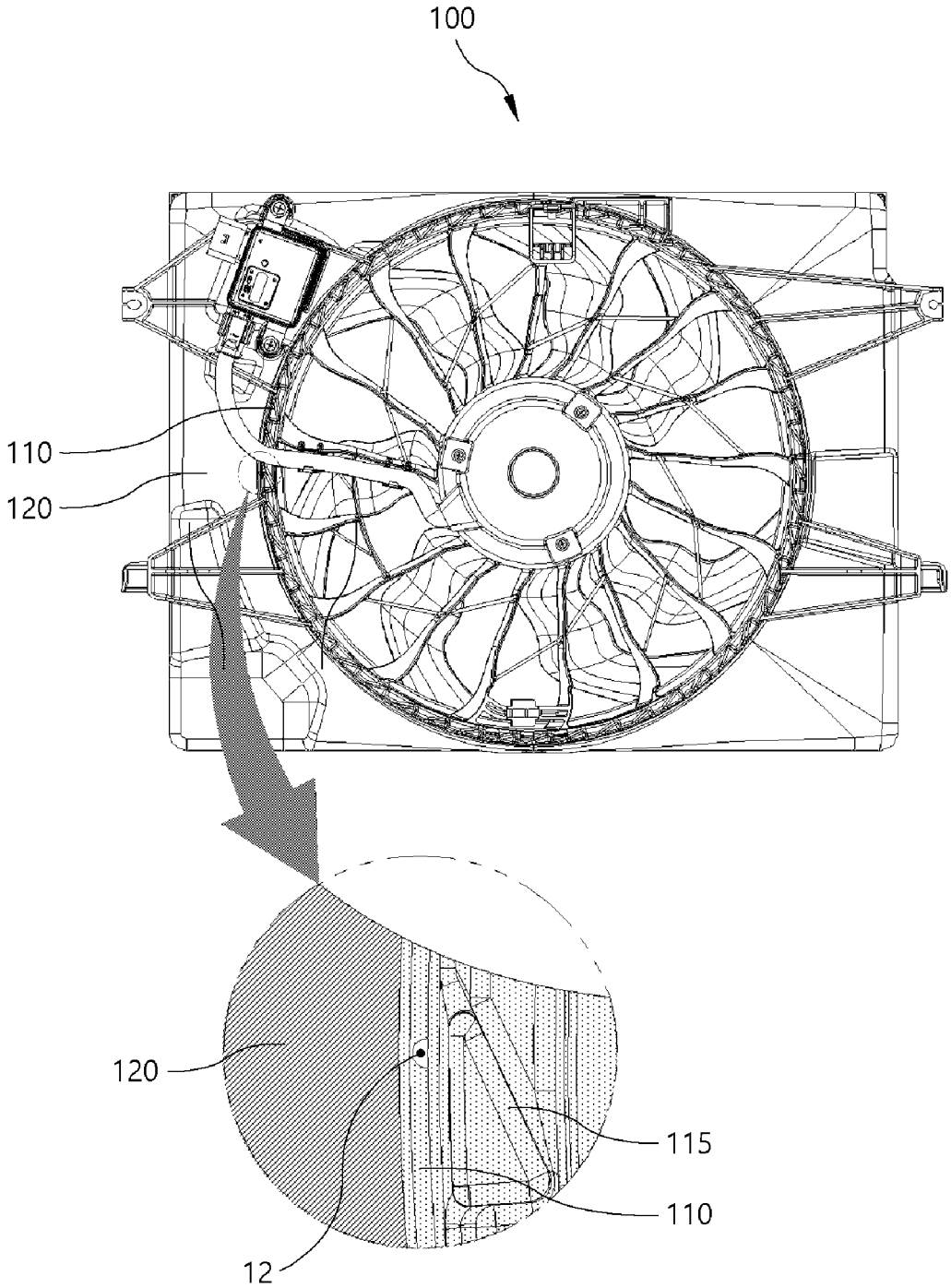
FIG. 5 is a front view of the fan shroud assembly of the present invention.

[1] Overall Configuration of Fan Shroud Having Noise-Reducing Hole According to Present Invention FIG. 3 is a perspective view of a fan shroud assembly of the present invention, FIG. 4 is a side view of the fan shroud assembly of the present invention, and FIG. 5 is a front view of the fan shroud assembly of the present invention. As illustrated in FIGS. 3 to 5, like a general fan shroud, a basic shape of a fan shroud 100 of the present invention includes a peripheral part 110 configured to surround an outer periphery of a fan 200, and a planar part 120 coupled to face a heat exchanger. Of course, a ventilation port 150, through which air is blown, is formed in a central portion of the peripheral part 110. A hub part 151 configured to accommodate and support a motor is provided in the ventilation port 150, and fixing members 152 configured to fix and support the hub part 151 are provided in the ventilation port 150. In addition, like the general fan shroud, the peripheral part 110 has a lateral surface protruding from a surface of the planar part 120. The peripheral part 110 may include anti-vortex serrated portions 115 formed in a serrated shape and arranged along a predetermined region of an outer peripheral surface of the peripheral part 110. As in the enlarged view in FIG. 1, a boundary between the peripheral part 110 and the planar part 120 is not clearly visible, as illustrated in enlarged views in FIGS. 3 to 5. Therefore, the peripheral part 110 is shown in a light color, and the planar part 120 is shown in a dark color.

In this case, at least one noise-reducing hole 10 is formed through the lateral surface of the peripheral part 110 of the fan shroud 100 of the present invention and communicates with the ventilation port 150, thereby controlling a part of an airflow passing through the ventilation port 150 and reducing BPF noise caused by the airflow. In this case, in case that the anti-vortex serrated portions 115 are provided on the peripheral part 110, the noise-reducing hole 10 may be formed in a region excluding a region in which the anti-vortex serrated portions 115 are formed. When the airflow is intentionally and additionally formed by the noise-reducing hole 10, a shape of a flow, which causes BPF noise, may be changed from an original airflow, which makes it possible to reduce the BPF noise.

The noise-reducing hole 10 of the present invention may be basically formed as a first hole 11 formed in the lateral surface of the peripheral part 110 and extending in a circumferential direction of the peripheral part 110. In addition, as illustrated in an enlarged view in FIG. 3 in detail, the noise-reducing hole 10 of the present invention may be formed in a shape connected to a second hole 12 formed in the lateral surface of the peripheral part 110, extending toward the planar part 120 so as to be inclined with respect to the first hole 11, and formed through the planar part 120. In this case, particularly, the first hole 11 and the second hole 12 may be perpendicularly connected. FIG. 4 is a side view of the fan shroud 100. As illustrated in an enlarged view in FIG. 4, a part of the first hole 11 and a part of the second hole 12, which are formed in the lateral surface of the peripheral part 110, are clearly illustrated. FIG. 5 is a front view of the fan shroud 100. As illustrated in the front surface, the lateral surface of the peripheral part 110 is not visible, and only a part of an end of the second hole 12 is illustrated in an enlarged view in FIG. 5.

As described above, the noise-reducing hole 10 of the present invention, which has a special shape, may be formed at an appropriate position on the fan shroud 100, thereby more effectively reducing the BPF noise. Hereinafter, various embodiments for deriving an optimal position, a basic shape, an optimal shape, and the like of the noise-reducing hole 10 will be described in more detail.

Figure 6:
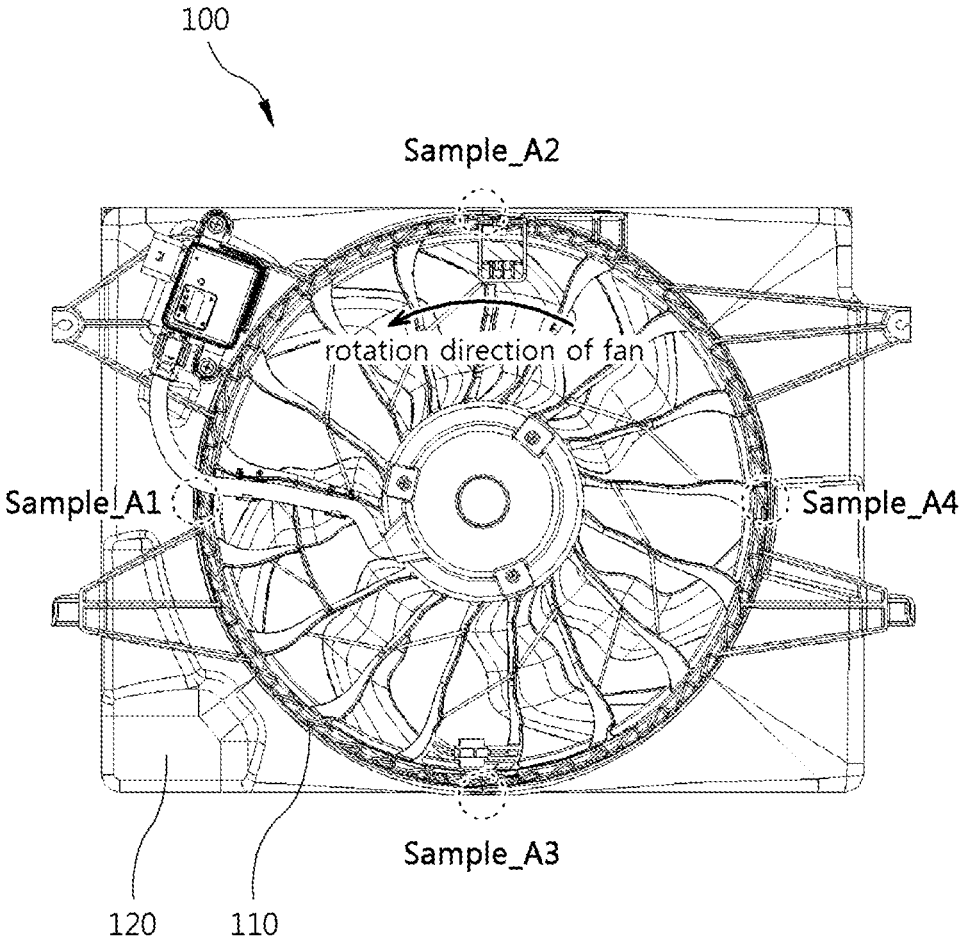
FIG. 6 is a view illustrating an experimental embodiment for deriving an optimal position of a noise-reducing hole of the present invention.

[2] Embodiment for Deriving Optimal Position of Noise-Reducing Hole in Fan Shroud of Present Invention FIG. 6 illustrates an experimental embodiment for deriving the optimal position of the noise-reducing hole of the present invention. As described above, in the fan shroud 100, the peripheral part 110 has an approximately circular shape, and the planar part 120 has an approximately rectangular shape. That is, the fan shroud 100 has a shape made by a combination of a circular shape defined by the peripheral part 110 and a rectangular shape defined by the planar part 120.

The ventilation port 150 is formed in the central portion of the peripheral part 110, and the planar part 120 is coupled to face the heat exchanger. A relatively large amount of air is accumulated and collected on a portion where the circular shape defined by the peripheral part 110 and the rectangular shape defined by the planar part 120 overlap each other or are disposed adjacent to each other, such that a large amount of air flows in the relatively narrow region, which causes the BPF noise. In the fan shroud 100 in the embodiment illustrated in FIG. 6, upper and lower narrow portions are present in which the circular shape of the peripheral part 110 and the rectangular shape of the planar part 120 overlap each other. First and second intermediate narrow portions, which are positions at which the peripheral part 110 has a maximum horizontal length, i.e., vertical centerline positions of the peripheral part 110. Because the noise-reducing hole 10 serves to reduce the BPF noise as described above, the noise-reducing hole 10 may be formed on at least one position selected from the narrow portions (the upper narrow portion, the lower narrow portion, and the first and second intermediate narrow portions).

Meanwhile, in consideration of structural rigidity of a structure, the noise-reducing hole 10 may be considered as a flaw formed in the structure. Therefore, the noise-reducing hole 10 may be minimally formed in consideration of the rigidity and durability of the fan shroud 100. The problems or relative advantages and disadvantages made by the narrow portions will be described below.

The upper narrow portion is a portion indicated by Sample_A2 in FIG. 6. In case that the noise-reducing hole 10 is formed in the upper narrow portion, a peripheral object is often disposed during a process of assembling various components of the vehicle. In addition, foreign substances dropped from above are dropped toward the fan 200 while passing through the noise-reducing hole 10, which causes a risk that the foreign substances apply undesired impact to the fan 200.

The lower narrow portion is a portion indicated by Sample_A3 in FIG. 6. However, in most cases, a discharge port for discharging surplus moisture, such as condensate water generated in the heat exchanger, is formed at a position of the lower narrow portion. Therefore, it is not feasible to form an additional hole.

The first intermediate narrow portion is a portion indicated by Sample_A1 in FIG. 6, and the second intermediate narrow portion is a portion indicated by Sample_A4 in FIG. 6. Both the first and second intermediate narrow portions are positioned on the vertical centerline position on the fan shroud 100, and a relatively larger amount of air is collected on the first and second intermediate narrow portions in comparison with the peripheral portion. Therefore, the first and second intermediate narrow portions are suitable for forming the noise-reducing hole 10. In this case, as described above, the noise-reducing hole 10 may be formed in any one selected from the first and second intermediate narrow portions in consideration of the rigidity and durability of the fan shroud instead of being formed in both the first and second intermediate narrow portions. In the fan shroud 100 exemplarily illustrated in FIG. 6, a width of the first intermediate narrow portion and a width of the second intermediate narrow portion, i.e., widths between the circular shape of the peripheral part 110 and the rectangular shape of the planar part 120 are equal to each other. Therefore, any one may be selected from the first and second intermediate narrow portions. Meanwhile, the fan shroud 100 may not be formed only vertically symmetrically, as illustrated in FIG. 6. The ventilation port 150 may sometimes be biased toward any one side between the left and right sides. In this case, the widths of the first and second intermediate narrow portions may, of course, be different from each other. In this case, a portion where a larger amount of air is accumulated may naturally be a portion having a smaller width.

In consideration of these various factors, the noise-reducing hole 10 may be basically formed only at any one selected from the positions of the first and second intermediate narrow portions. In addition, on the assumption that the widths of the first and second intermediate narrow portions are widths between the circular shape of the peripheral part 110 and the rectangular shape of the planar part 120 at the positions of the first and second intermediate narrow portions, the noise-reducing hole 10 may be formed only at a side at which the width is small in case that the widths of the first and second intermediate narrow portions are different from each other.

Figure 7:
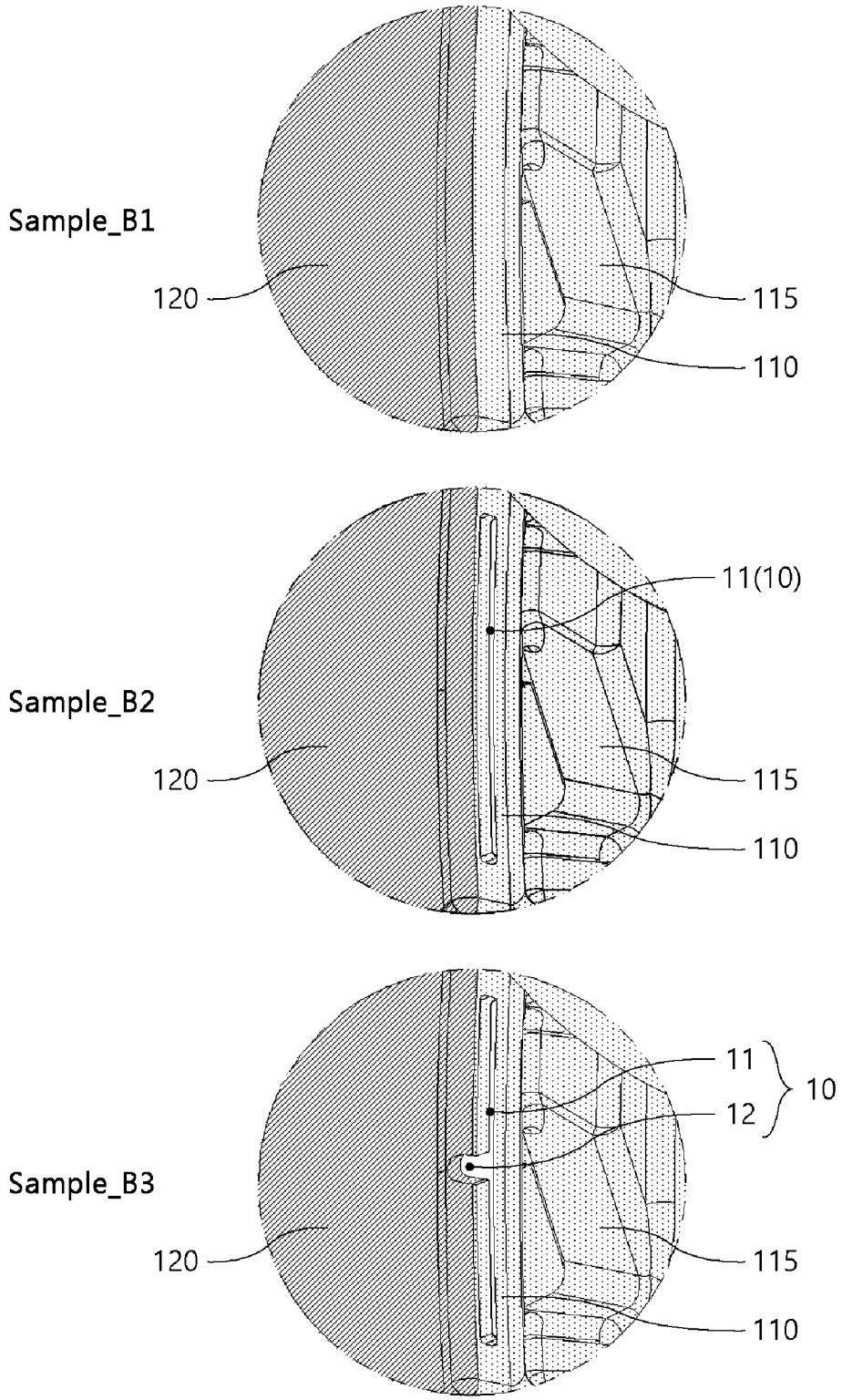
FIG. 7 is a view illustrating an experimental embodiment for deriving a basic shape of the noise-reducing hole of the present invention.

[3] Embodiment for Deriving Basic Shape of Noise-Reducing Hole in Fan Shroud of Present Invention FIG. 7 illustrates an experimental embodiment for deriving the basic shape of the noise-reducing hole of the present invention. In other words, the experiment in FIG. 7 is an experiment related to a process in which the noise-reducing hole 10 is derived in a shape in which the first hole 11 and the second hole 12 are combined, i.e., a process in which the basic shape of the noise-reducing hole 10 of the present invention is derived.

In the experiment illustrated in the upper view in FIG. 7, i.e., indicated by Sample_B1, the noise-reducing hole 10 is not formed, i.e., the experiment corresponds to the fan shroud in the related art illustrated in FIG. 1. In the experiment illustrated in the middle view in FIG. 7, i.e., indicated by Sample_B2, the noise-reducing hole 10 is formed only by the first hole 11. Lastly, in the experiment illustrated in the lower view in FIG. 7, i.e., indicated by Sample_B3, the noise-reducing hole 10 is formed by the first hole 11 and the second hole 12, such that air is more smoothly discharged.

TABLE 1

| | Test Conditions | | | | | O/A (dBA) Front | Max. Peak | | | Improvements | |
|---|---|---|---|---|---|---|---|---|---|---|---|
| | DUTY | Volt | Amps | rpm | W | 1000 mm | dBA | Hz | Order | OA | BPF |
| Sample_B1 | 13.0 | 85 | 24.6 | 2145 | 320 | 73.3 | 66.2 | 250.3 | FAN | — | — |
| | 13.0 | 90 | 28.9 | 2250 | 376 | 74.7 | 68.9 | 262.5 | FAN | — | — |
| Sample_B2 | 13.0 | 85 | 24.8 | 2145 | 322 | 72.9 | 63.5 | 250.3 | FAN | −0.4 | −2.7 |
| | 13.0 | 90 | 29.0 | 2255 | 377 | 74.2 | 66.5 | 263.1 | FAN | −0.5 | −2.4 |

TABLE 1-continued

| | Test Conditions | | | | | O/A (dBA) Front | Max. Peak | | | Improvements | |
|---|---|---|---|---|---|---|---|---|---|---|---|
| | DUTY | Volt | Amps | rpm | W | 1000 mm | dBA | Hz | Order | OA | BPF |
| Sample_B3 | 13.0 | 85 | 24.5 | 2145 | 319 | 72.8 | 63.1 | 250.3 | FAN | −0.5 | −3.1 |
| | 13.0 | 90 | 28.9 | 2255 | 376 | 74.2 | 66.1 | 263.1 | FAN | −0.5 | −2.8 |

As clearly shown in the results in Table 1, it can be ascertained that the BPF noise is reduced by about 2.5 dB in Sample_B2 having the noise-reducing hole 10 formed only by the first hole 11 in comparison with Sample_B1 that corresponds to the fan shroud in the related art in which the noise-reducing hole 10 is not formed. In addition, it can be ascertained that in comparison with Sample_B2, the BPF noise is reduced by about 3 dB and more excellent performance is exhibited in Sample_B3 in which the noise-reducing hole 10 is formed by a combination of the first hole 11 and the second hole 12. That is, it has been experimentally proven that the effect of reducing the BPF noise is improved as the accumulated air is more smoothly discharged when the second hole 12 is further formed.

The configuration of the present invention in which the noise-reducing hole 10 is formed by the combination of the first hole 11 and the second hole 12 is made by applying the above-mentioned experimental result.

Figure 8:
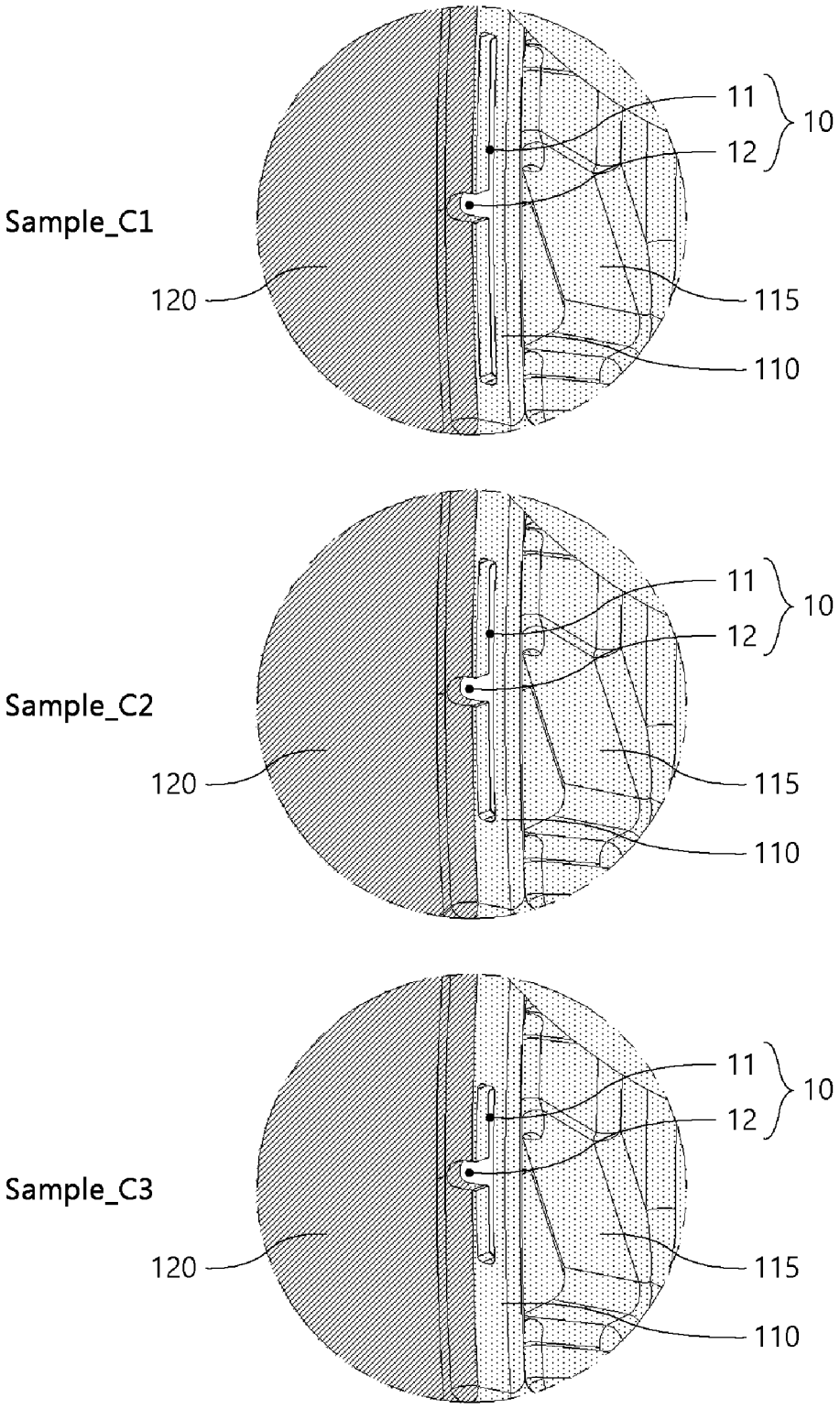
FIG. 8 is a view illustrating an experimental embodiment for deriving an optimal shape of the noise-reducing hole of the present invention.

[4] Embodiment for Deriving Optimal Shape of Noise-Reducing Hole in Fan Shroud of Present Invention FIG. 8 illustrates an experimental embodiment for deriving the optimal shape of the noise-reducing hole of the present invention. More specifically, FIG. 8 illustrates the experiment performed while varying lengths of the first hole 11. Samples_C1 to C3 illustrated in the upper and lower views in FIG. 8 were tested by sequentially changing the length of the first hole 11 to 45 mm, 35 mm, and 25 mm. The specific test conditions are shown in Table 2 below.

structurally damaged portion in the fan shroud 100, the excessively large noise-reducing hole 10 may cause the deterioration in undesired rigidity and durability.

In consideration of these various factors, the noise-reducing hole 10 may be formed such that the length of the first hole 11 is longer than the length of the second hole 12 and shorter than 5% of a circumference length of the peripheral part 110. When the dimensions of the general fan shroud 100 are expressed in specific numerical values, the noise-reducing hole 10 may be formed such that the length of the first hole 11 is within a range of 30 to 50 mm.

Figure 9:
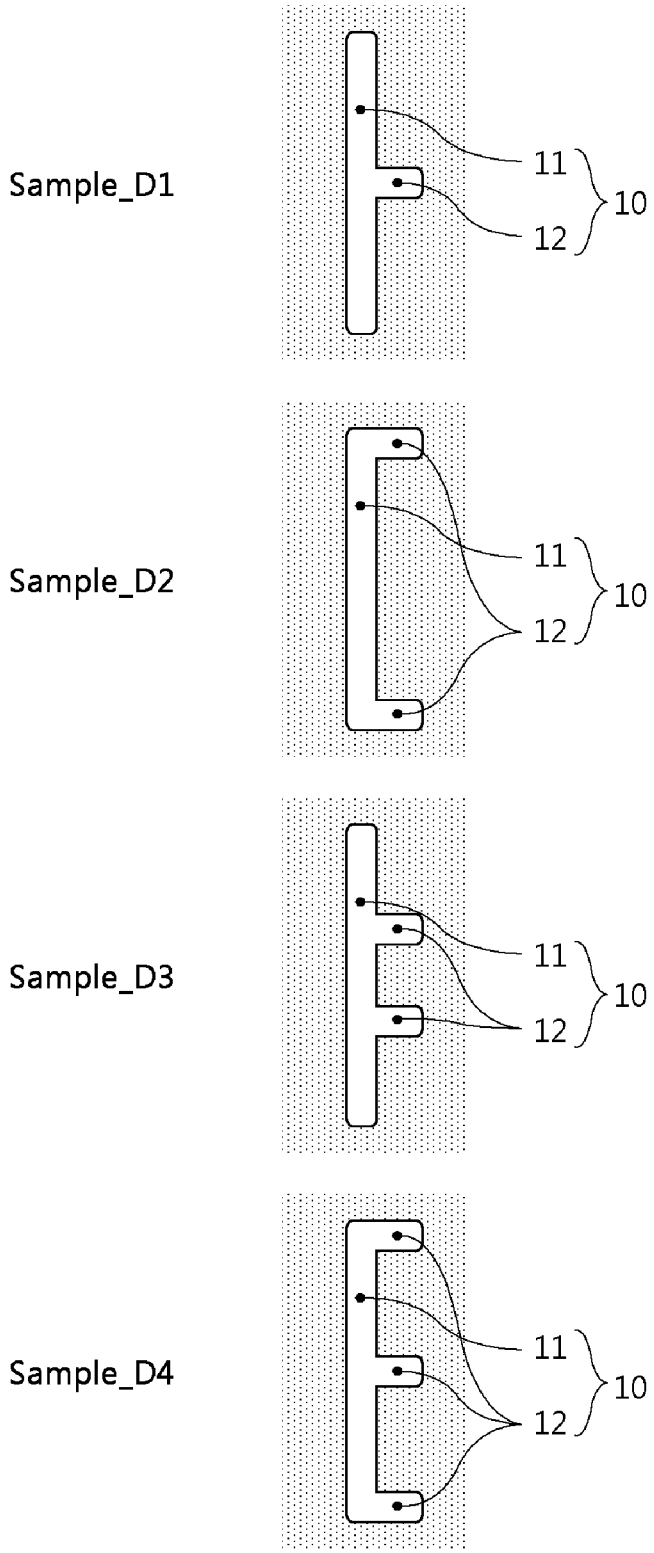
FIG. 9 is a view illustrating various embodiments of shapes of the noise-reducing hole of the present invention.

FIG. 9 illustrates various embodiments of shapes of the noise-reducing hole of the present invention. Like the previously performed experiments, Sample_D1 in FIG. 9 is a case in which the single second hole 12 is formed for the single first hole 11, and the second hole 12 is formed at a center position based on the extension direction of the first hole 11. Samples_D2 to D4 in FIG. 9 are cases in which the plurality of second holes 12 is formed for the single first hole 11. Sample_D2 is a case in which the second holes 12 are formed at two opposite ends of the first hole 11. Sample_D3 is a case in which the plurality of second holes 12 is formed to be biased at the center position of the first hole 11. Sample_D4 is a case in which the second holes 12 are formed at all the two opposite ends and the center position of the first hole 11.

It can be expected that the effect of discharging air is improved as the number of second holes 12 increases.

TABLE 2

| | Test Conditions | | | | | O/A (dBA) Front | Max. Peak | | | Improvements | |
|---|---|---|---|---|---|---|---|---|---|---|---|
| | DUTY | Volt | Amps | rpm | W | 1000 mm | dBA | Hz | Order | OA | BPF |
| Sample_C1 | 13.0 | 85 | 24.6 | 2145 | 319 | 72.8 | 63.1 | 250.3 | FAN | −0.5 | −3.1 |
| | 13.0 | 90 | 28.9 | 2255 | 376 | 74.2 | 66.1 | 263.1 | FAN | −0.5 | −2.8 |
| Sample_C2 | 13.0 | 85 | 24.8 | 2145 | 320 | 7.9 | 63.5 | 250.3 | FAN | −0.4 | −2.7 |
| | 13.0 | 90 | 29.0 | 2255 | 373 | 74.2 | 66.4 | 263.1 | FAN | −0.5 | −2.5 |
| Sample_C3 | 13.0 | 85 | 24.5 | 2145 | 320 | 72.9 | 64.2 | 250.3 | FAN | −0.4 | −2.1 |
| | 13.0 | 90 | 28.9 | 2255 | 376 | 74.3 | 67.0 | 263.1 | FAN | −0.4 | −1.9 |

As clearly shown in the results in Table 2, the effect of reducing the BPF noise is improved as the length of the first hole 11 increases. Specifically, it can be ascertained that the BPF noise is reduced by about 3 dB in Sample_C1 in which the length of the first hole 11 is 45 mm, the BPF noise is reduced by about 2.5 dB in Sample_C2 in which the length of the first hole 11 is 35 mm, and the BPF noise is reduced by about 2 dB in Sample_C3 in which the length of the first hole 11 is 25 mm.

As such, it can be considered that the longer length of the first hole 11 is effective only based on the fact that the effect of reducing the BPF noise is improved as the length of the first hole 11 increases. However, as described above, because the noise-reducing hole 10 itself may act as a However, actually, the effect of discharging air is excellent when the second hole 12 is formed at the center position of the first hole 11, and the effect tends to significantly deteriorate as the position of the second hole 12 approaches the two opposite ends. Further, from the point of view of manufacturability, there is a problem in that the more complex the shape of the noise reduction hole 10, the more difficult it is to manufacture the noise-reducing hole 10. In consideration of these factors, as in Sample_D1 in FIG. 9, the noise-reducing hole 10 may be formed such that the single second hole 12 is formed for the single first hole 11, and the second hole 12 is formed at the center position based on the extension direction of the first hole 11.

Meanwhile, the widths of the first and second holes 11 and 12 may be considered. For ease of design, it may be easiest to form the first and second holes 11 and 12 having the same width. However, in consideration of the effect of discharging air, the width of the second hole 12 may be larger than the width of the first hole 11. However, the widths of the first and second holes 11 and 12 may be within a range of 10 to 30 mm in consideration of the dimensions of the general fan shroud 100 so that the rigidity and durability of the fan shroud 100 are not unnecessarily excessively reduced because of the presence of the noise-reducing hole 10, as described above.

The present invention is not limited to the above embodiments, and the scope of application is diverse. Of course, various modifications and implementations made by any person skilled in the art to which the present invention pertains without departing from the subject matter of the present invention claimed in the claims.

INDUSTRIAL APPLICABILITY

According to the present invention, the hole having the optimized shape is formed at the appropriate position on the fan shroud, such that a great effect of effectively reducing the BPF noise may be obtained. The compatibility of the hole is high because the hole is applied without changing the entire structure of the fan shroud in the related art, which is advantageous in manufacturing and producing the fan shroud.

What is claimed is:

1. A fan shroud assembly comprising: a fan comprising a hub coupled to a rotary shaft of a motor, and a plurality of blades provided on an outer peripheral surface of the hub; and a fan shroud comprising a peripheral part configured to surround an outer periphery of the fan, a planar part coupled to face a heat exchanger, a ventilation port provided in the form of an empty space formed in a central portion of the peripheral part and configured to allow an airflow, which is generated by the fan, to pass through the ventilation port to blow air, a hub part formed at a center of the ventilation port and configured to accommodate and support the motor provided on a shaft of the fan, and a plurality of fixing members connected to an inner peripheral edge of the peripheral part and an outer peripheral edge of the hub part and disposed radially around the hub part, wherein a lateral surface of the peripheral part is formed by protruding from the surface of the planar part, and wherein at least one noise-reducing hole is formed through the lateral surface of the peripheral part and communicates with the ventilation port to control a part of the airflow passing through the ventilation port; wherein when a portion where a circular shape defined by the peripheral part and a rectangular shape defined by the planar part overlap each other or are disposed adjacent to each other is referred to as a narrow portion, the fan shroud has upper and lower narrow portions where the circular shape of the peripheral part and the rectangular shape of the planar part overlap each other, and first and second intermediate narrow portions that are positions at which the peripheral part has a maximum horizontal length, which is vertical centerline positions of the peripheral part, and wherein the noise-reducing hole is formed on at least one position selected from the upper narrow portion, the lower narrow portion, and the first and second intermediate narrow portions.

2. The fan shroud assembly of claim 1, wherein the noise-reducing hole is formed by a first hole formed in the lateral surface of the peripheral part and extending in a circumferential direction of the peripheral part.

3. The fan shroud assembly of claim 2, wherein the noise-reducing hole is formed by connecting a second hole formed in the lateral surface of the peripheral part, extending toward the planar part so as to be inclined with respect to the first hole, and formed through the planar part.

4. The fan shroud assembly of claim 3, wherein the first hole and the second hole are perpendicularly connected in the noise-reducing hole.

5. The fan shroud assembly of claim 1, wherein the noise-reducing hole is formed only in any one selected from the first and second intermediate narrow portions.

6. The fan shroud assembly of claim 5, wherein when widths of the first and second intermediate narrow portions are widths between the circular shape of the peripheral part and the rectangular shape of the planar part at the positions of the first and second intermediate narrow portions, the noise-reducing hole is formed only at a side at which the width is small when the widths of the first and second intermediate narrow portions are different from each other.

7. The fan shroud assembly of claim 3, wherein the noise-reducing hole is formed such that a length of the first hole is longer than a length of the second hole and shorter than 5% of a circumference length of the peripheral part.

8. The fan shroud assembly of claim 7, wherein the noise-reducing hole is formed such that the length of the first hole is within a range of 30 to 50 mm.

9. The fan shroud assembly of claim 3, wherein the noise-reducing hole is formed such that at least one second hole is formed for the single first hole.

10. The fan shroud assembly of claim 3, wherein the noise-reducing hole is formed such that the single second hole is formed for the single first hole, and the second hole is formed at a center position based on an extension direction of the first hole.

11. The fan shroud assembly of claim 3, wherein the noise-reducing hole is formed such that widths of the first and second holes are within a range of 10 to 30 mm.

12. The fan shroud assembly of claim 1, wherein the peripheral part comprises anti-vortex serrated portions formed in a serrated shape and arranged along a predetermined region of an outer peripheral surface of the peripheral part, and wherein the noise-reducing hole is formed in a region excluding a region in which the anti-vortex serrated portion is formed.

* * * * *